US012144480B2

(12) United States Patent
Calvimontes et al.

(10) Patent No.: US 12,144,480 B2
(45) Date of Patent: Nov. 19, 2024

(54) DISHWASHER, ARRANGEMENT HAVING A DISHWASHER, AND METHOD FOR OPERATING A DISHWASHER

(71) Applicant: BSH Hausgeräte GmbH, Munich (DE)

(72) Inventors: Alfredo Calvimontes, Dillingen a.d. Donau (DE); Kai Paintner, Welden (DE); Kuldeep Narayan Singh, Dillingen a.d. Donau (DE); Michael Rupp, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 314 days.

(21) Appl. No.: 17/781,765

(22) PCT Filed: Dec. 3, 2020

(86) PCT No.: PCT/EP2020/084424

§ 371 (c)(1),
(2) Date: Jun. 2, 2022

(87) PCT Pub. No.: WO2021/122030

PCT Pub. Date: Jun. 24, 2021

(65) Prior Publication Data

US 2023/0036605 A1 Feb. 2, 2023

(30) Foreign Application Priority Data

Dec. 20, 2019 (DE) ..... 102019220423

(51) Int. Cl.
*A47L 15/42* (2006.01)
*A47L 15/00* (2006.01)
*A47L 15/46* (2006.01)

(52) U.S. Cl.
CPC ..... *A47L 15/4295* (2013.01); *A47L 15/0028* (2013.01); *A47L 15/0063* (2013.01);
(Continued)

(58) Field of Classification Search
CPC ..... A47L 15/4295
See application file for complete search history.

(56) References Cited

U.S. PATENT DOCUMENTS 10,285,559 B2 5/2019 Caroline
10,905,305 B2 2/2021 Monsrud
(Continued)

FOREIGN PATENT DOCUMENTS

CN 108836211 A 11/2018
DE 102016106430 A1 11/2016
(Continued)

OTHER PUBLICATIONS

National Search Report DE 102019220423 dated Dec. 17, 2020.
International Search Report PCT/EP2020/084424 dated Jan. 28, 2021.

*Primary Examiner* — Jason Y Ko
(74) *Attorney, Agent, or Firm* — Michael E. Tschupp; Andre Pallapies; Brandon G. Braun

(57) ABSTRACT

A dishwasher includes a controller for executing a washing program for washing a dirty item to be washed, and a receiving unit for receiving a sensor signal indicative of a dirt type adhering to the dirty item to be washed from a plurality of dirt types, with each of the dirt types being determined by a dirt parameter matrix, in which each position is assigned to a dirt parameter. A determining unit determines the dirt type adhering to the dirty item to be washed as a function of the received sensor signal, with the controller executing the washing program as a function of the determined dirt type.

13 Claims, 5 Drawing Sheets

(52) U.S. Cl.
CPC ..... *A47L 15/4293* (2013.01); *A47L 15/46* (2013.01); *A47L 2301/06* (2013.01); *A47L 2401/04* (2013.01); *A47L 2401/34* (2013.01); *A47L 2501/30* (2013.01)

(56) References Cited

U.S. PATENT DOCUMENTS

| | | | | |
|---|---|---|---|---|
| 2007/0046942 | A1 | 3/2007 | Ng | |
| 2008/0276966 | A1 | 11/2008 | Yusuf | |
| 2009/0071508 | A1 | 3/2009 | Sundaram | |
| 2019/0239716 | A1 | 8/2019 | Choi | |
| 2020/0093347 | A1 * | 3/2020 | Shashidhar | A47L 15/449 |
| 2020/0178755 | A1 | 6/2020 | Terrádez Alemany | |
| 2021/0127942 | A1 | 5/2021 | Terrádez Alemany | |

FOREIGN PATENT DOCUMENTS

| | | | |
|---|---|---|---|
| WO | WO0244460 | A1 * | 6/2002 |
| WO | 2014090732 | A1 | 6/2014 |

* cited by examiner

SMX:

$$\begin{pmatrix} a_11 & a_12 & \dots & a_1m \\ a_21 & & & \vdots \\ \vdots & & & \\ a_n1 & \dots & & a_nm \end{pmatrix}$$

Fig. 2

MXA:

$$\begin{pmatrix} (0,1\text{-}0,15) & (0,8\text{-}0,95) \\ (0,0\text{-}0,02) & (0,3\text{-}0,8) \end{pmatrix}$$

MXB:

$$\begin{pmatrix} (0,01\text{-}0,03) & (0,2\text{-}0,5) \\ (0,35\text{-}0,4) & (0,77\text{-}0,89) \end{pmatrix}$$

MXC:

$$\begin{pmatrix} (0,08\text{-}0,16) & (0,7\text{-}0,85) \\ (0,1\text{-}0,27) & (0,9\text{-}1,0) \end{pmatrix}$$

MXI:

$$\begin{pmatrix} 0,1 & 0,8 \\ 0,02 & 0,38 \end{pmatrix}$$

Fig. 3

21: Image Processing Unit
23: Generating Unit
24: Comparison Unit
25: Learning Unit
26: Statistics Unit

DISHWASHER, ARRANGEMENT HAVING A DISHWASHER, AND METHOD FOR OPERATING A DISHWASHER

CROSS-REFERENCES TO RELATED APPLICATIONS

This application is the U.S. National Stage of International Application No. PCT/EP2020/084424, filed Dec. 3, 2020, which designated the United States and has been published as International Publication No. WO 2021/122030 A1 and which claims the priority of German Patent Application, Serial No. 10 2019 220 423.6, filed Dec. 20, 2019, pursuant to 35 U.S.C. 119 (a)-(d).

The contents of International Application No. PCT/EP2020/084424 and German Patent Application, Serial No. 10 2019 220 423.6 are incorporated herein by reference in their entireties as if fully set forth herein.

BACKGROUND OF THE INVENTION

The present invention relates to a dishwasher, an arrangement having a dishwasher and a computing unit as well as a method for operating a dishwasher.

Known dishwashers comprise a sensor system which is able to detect different operating parameters during the execution of a washing program. According to the value of an operating parameter, a controller of the dishwasher may adapt one or more washing program parameters in order to improve the washing result. For example, sensors which analyze the washing liquor and thus draw conclusions about a dirt load in the washing liquor are known. For example, the washing liquor may be replaced entirely or partially by fresh water as a function of the determined dirt load.

US 2009/0071508 A1 discloses a dishwasher with a controllable spray arm which may be controlled such that it emits a washing liquid in a targeted manner onto regions having an increased level of soiling.

DE 10 2012 223 243 A1 discloses a household appliance which is configured for the transmission of data to a mobile terminal with an integrated camera. An image of the soiling in or on the household appliance may be detected by the camera of the mobile terminal and transmitted to a server which analyses the image of the soiling and transmits a cleaning program which is appropriate for the soiling to the mobile terminal.

DE 10 2014 208 861 A1 discloses a water-conducting household appliance which has a receiving unit for receiving at least one signal from a device coupled to the household appliance, a number of actuators for executing a plurality of programs, a selector unit for selecting a program from the plurality of programs as a function of the at least one signal received and an activation unit which is configured to activate the actuators for executing the selected program.

BRIEF SUMMARY OF THE INVENTION

Against this background, an object of the present invention is to provide an improved dishwasher.

According to a first aspect, a dishwasher, in particular a household dishwasher, having a controller for executing a washing program for washing dirty items to be washed is proposed. The dishwasher comprises a receiving unit for receiving a sensor signal indicative of a dirt type adhering to the dirty items to be washed from a plurality of dirt types, wherein each of the dirt types is determined by a dirt parameter matrix in which each position is assigned to a dirt parameter. Moreover, a determining unit is provided, said determining unit being configured to determine the dirt type adhering to the dirty items to be washed as a function of the received sensor signal. The controller is configured to execute the washing program as a function of the determined dirt type.

This dishwasher has the advantage that the controller may optimally adapt the washing program to the determined dirt types, which is why a washing result is optimized.

The controller may be implemented in terms of hardware technology and/or software technology. In the case of an implementation in terms of hardware technology, the controller may be configured, for example, as a computer or as a microprocessor. In the case of an implementation in terms of software technology, the controller may be configured as a computer program product, as a function, as a routine, as part of a program code or as an executable object.

The respective unit, for example the receiving unit and the determining unit, may be implemented in terms of hardware technology and/or software technology. In the case of an implementation in terms of hardware technology, the respective unit may be configured, for example, as a computer or as a microprocessor. In the case of an implementation in terms of software technology, the respective unit may be configured as a computer program product, as a function, as a routine, as part of a program code or as an executable object. Moreover, the respective unit may form a constituent part of a different unit or the controller.

The receiving unit comprises, for example, a modem and is coupled or temporarily couplable to at least one sensor. The coupled or couplable sensor is configured to output the sensor signal to the receiving unit.

The sensor signal is indicative of the dirt type adhering to the dirty items to be washed, wherein a plurality of dirt types are differentiated. Each of the dirt types is determined by a dirt parameter matrix. It can also be said that the dirt parameter matrix forms a fingerprint for the respective dirt type. Each position in the dirt parameter matrix, i.e. each matrix entry, is assigned to a dirt parameter. A "dirt parameter" is understood to mean, in particular, an abstract value which may be calculated, for example, from the sensor signal by means of a predetermined method or algorithm. In this regard, a predetermined method or an algorithm may be assigned to each dirt parameter. A predetermined method in this case may also comprise a machine learning method.

It should be mentioned that the dirt parameters may also be present in a different arrangement from that of a matrix, for example as a list, a table or the like. The arrangement in a matrix may be advantageous for mathematical operations.

For example, the dirt type "ketchup" may be identified in a photograph. Ketchup frequently has a reddish color which is why it provides a means of analyzing the red coloration of stains in the photograph. This may be carried out by means of a corresponding algorithm, which outputs the value "1" as a result of a completely red stain and outputs the value "0" with a stain in which the color red does not appear. A high value of the dirt parameter thus defined is therefore an indication that the dirt type "ketchup" is present. In order to avoid confusion with other dirt types, such as for example red wine, further dirt parameters may be defined, such as for example a morphology and/or a structure of the stain.

The determining unit is configured to determine the dirt type adhering to the items to be washed. In this case, the determining unit may be configured, in particular, to determine at least one dirt type for each soiling or for each stain on the items to be washed.

For example, the determining unit as described above determines one or more of the dirt parameters as a function of the sensor signal. The determination of the dirt type may become more accurate with each additional determined dirt parameter. This may be carried out, in particular, by an exclusion method. For example, using the above-defined dirt parameter (red coloration) ketchup and red wine may be almost certainly excluded when a specific threshold value for this dirt parameter is not reached.

In the case of soiling which comprises different dirt types, such as for example a mixture of ketchup and mayonnaise, the determining unit may determine, for example, a percentage of the respectively encompassed dirt types. Moreover, for spatially distributed dirt, a different dirt type may be determined for different regions on the items to be washed.

The controller may execute an optimal washing program according to the determined dirt types. In this case, different washing program parameters may be adapted, such as for example a water quantity, a washing liquor temperature, a recirculating pump speed, a duration of individual washing program sections such as prewashing, main washing, rinsing with rinse aid and/or drying, a quantity and/or type of a metered detergent, metering times for the detergent or a plurality of different detergents, such as for example cleaning agents, enzymes, rinse aid, bleach and the like. Thus both an optimal washing result may be achieved and a minimizing of the use of chemicals for assisting the washing process and the water and/or energy consumption may be achieved.

In embodiments of the dishwasher, this dishwasher comprises an automatic metering system which is configured for the automatic metering of at least one cleaning agent. Preferably, the automatic metering system is configured to meter a plurality of cleaning agents as required. The controller of the dishwasher in this case is configured, in particular, to activate the automatic metering system.

According to one embodiment of the dishwasher, the sensor signal comprises image information of the dirty items to be washed.

The image information is, for example, a digital photograph of the dirty items to be washed, which is detected by a camera of the dishwasher or even by an external camera and transmitted to the receiving unit.

A dirt type may be determined on the basis of the image information. In this case, for example, an appearance of soiling of the items to be washed, i.e. geometric and/or morphological factors of the soiling, are considered. Moreover, a dirt type may be concluded indirectly via a shape and/or a material of the items to be washed, since a liquid food such as a soup, for example, is served in a bowl or the like. The shape and/or the material of the items to be washed may be also determined on the basis of the image information.

According to a further embodiment of the dishwasher, the determining unit comprises an image processing unit which is configured to determine a value of at least one of the dirt parameters contained in the dirt parameter matrix as a function of the image information.

The image processing unit may have, in particular, a graphic processor and/or a neural network.

According to a further embodiment of the dishwasher, a database unit, a generating unit and a comparison unit are provided, wherein the database unit is configured to store a dirt parameter matrix for each of the plurality of dirt types, wherein one respective dirt parameter matrix comprises a predetermined value or value range for each of the dirt parameters, wherein the generating unit is configured to generate a current dirt parameter matrix as a function of the determined value of the at least one dirt parameter, wherein the comparison unit is configured to compare the generated current dirt parameter matrix with at least one subset of the dirt parameter matrices stored in the database unit and to output a comparison result, and wherein the determining unit is configured to determine the dirt type adhering to the dirty items to be washed as a function of the comparison result.

The dirt parameter matrices stored in the database unit form a reference, the entries thereof, i.e. the values of the dirt parameters, being typical values of a specific dirt type. These reference matrices are provided, for example, by the manufacturer of the dishwasher.

For example, a dirt parameter matrix will be determined for items to be washed which are soiled with precisely one dirt type. In this case, it is advantageous if the dirt type is not mixed with other dirt types. In order to consider a certain scattering of individual values of dirt parameters which may result, for example, from a lighting situation when the image of the items to be washed is captured, an interval and/or a tolerance range or error range may be specified instead of an individual value in the respective dirt parameter matrix for a dirt type. The interval or the tolerance range may be determined, in particular empirically, by a respective value of a dirt parameter being determined for a plurality of different sensor signals, said sensor signals having been detected in each case by an item to be washed with precisely the one dirt type, and then a statistical evaluation of the plurality of values being carried out.

In embodiments it may be provided that different dirt parameter matrices are stored for different combinations of the dirt type and material of the items to be washed since, for example, a shape of a stain may depend on the material of the items to be washed, such as plastic, glass, metal or porcelain.

The generating unit generates a current dirt parameter matrix, the values thereof being determined or calculated as a function of the received sensor signal.

The comparison unit compares the generated current dirt parameter matrix with one or more of the stored dirt parameter matrices. "Comparing" in this case is understood to mean in particular that each entry of the current dirt parameter matrix is compared with the corresponding entry of exactly one of the stored dirt parameter matrices which corresponds to exactly one dirt type. An individual comparison value which represents a measurement of a match is determined for each of these comparisons of individual values of dirt parameters. The measuring system used here may be configured in various ways. In particular, it may be provided that the measuring system is different for different dirt parameters of a dirt parameter matrix. Moreover, the measuring system may be different for the same dirt parameters with different dirt types, i.e. for different dirt parameter matrices. In this manner, a weighting of particularly characteristic dirt parameters for individual dirt types may be achieved.

On the basis of all of the individual comparison values, the comparison result is output relative to the comparison of the current dirt parameter matrix with exactly one of the stored dirt parameter matrices. The comparison result, in particular, is an indicator of whether the respective dirt type is present or not on the items to be washed. For example, in the case of identical matrices a 100% match may be output as the comparison result. It should be mentioned that an individual comparison value does not necessarily have to be present for each dirt parameter in order to determine the comparison result. If only a few individual comparison values are present, this may made clear for example by means of an error or confidence interval relative to the comparison result. In this case, the error or the confidence interval is determined by the comparison unit and output with the comparison result.

The determining unit determines on the basis of the comparison result which dirt type adheres to the items to be washed. For example, the determining unit detects the comparison result of the comparison unit for each comparison carried out, preferably for each of the stored dirt parameter matrices. The determining unit is configured, for example, to determine a plurality of dirt types. The determination of whether a dirt type is present on the items to be washed may be carried out in turn by means of different measuring systems.

For example with a 100% match it is determined that the corresponding dirt type is present on the items to be washed.

According to a further embodiment of the dishwasher, a learning unit is provided, said learning unit being configured to adapt at least one of the dirt parameter matrices stored in the database unit as a function of determined values of at least one dirt parameter.

It can also be said that the learning unit is configured to optimize the at least one stored dirt parameter matrix. For example, this may be carried out in the context of a learning mode in which a user specifically predetermines items to be washed which are soiled with individual dirt types. Alternatively, in normal operation of the dishwasher a confirmation of a specific dirt type may be requested from the user. By regular requests of this type, the determination of the dirt type may be continuously improved over time.

According to a further embodiment of the dishwasher, the sensor signal comprises information relating to a washing liquor used for washing the dirty items to be washed.

For example, the dishwasher has a washing liquor sensor which detects a turbidity of the washing liquor during the washing program. The turbidity of the washing liquor may be contained in the form of a dirt parameter in the dirt parameter matrix for one respective dirt type. Thus the determination of the dirt type may be further improved.

Apart from the turbidity of the washing liquor, for example, a particle size of particles released in the washing liquor, a conductivity of the washing liquor and/or a pH value of the washing liquor may be detected and output as a sensor signal.

According to a further embodiment of the dishwasher, the sensor signal comprises information relating to a food prepared and/or consumed by a user of the dishwasher in a specific time interval before a start of the washing program.

For example, the dishwasher is networked with a food processor, a hob and/or an oven, or even with a digital cookbook and/or calendar used by the user. Such a networking may be carried out, for example, via a WLAN or LAN or even by means of Bluetooth®. The specific time interval is, for example, a few hours or a day.

According to a further embodiment of the dishwasher, the controller is configured to adapt the execution of a running washing program.

The adaptation is preferably carried out as a function of a sensor signal received during the execution, such as for example a sensor signal received by a turbidity sensor.

According to a further embodiment of the dishwasher, a camera is arranged on the dishwasher, wherein the camera is configured to detect an optical sensor signal of the items to be washed and to output the detected optical sensor signal to the receiving unit.

The camera is arranged, in particular, on the dishwasher such that this camera detects the optical sensor signal of the items to be washed when the dishwasher is loaded with the items to be washed.

According to a further embodiment of the dishwasher, a statistics unit is provided, said statistics unit being configured to determine a frequency distribution, which comprises a frequency of the occurrence of different dirt types, wherein the determining unit is configured to determine the dirt type adhering to the dirty items to be washed as a function of the frequency distribution.

The statistics unit determines the frequency distribution, in particular as a function of determined dirt types and over longer time periods. In other words, the statistics unit stores, for example, each determined dirt type, preferably together with a respective time stamp of the determination time. For each of the dirt types, therefore, there is a certain statistical probability for the occurrence thereof. For different users, the frequency distribution may be different due to different preferences. For example, patterns relative to an occurrence of specific dirt types over time may also be taken from the frequency distribution. An example of a pattern is that fish with potatoes is eaten on Fridays, resulting in specific dirt types. A further example of a pattern is that wine is consumed, in particular, in the evening. The frequency distribution may be advantageous if, during the determination, two dirt types are determined with the same uncertainty, i.e. when the comparison result thereof is the same. Thus, for example, the dirt type occurring more frequently in the frequency distribution may be selected since the probability of the occurrence thereof is greater.

In embodiments, a correlation unit may be provided, said correlation unit, in particular, also being able to be a constituent part of the statistics unit. The correlation unit is configured to provide a correlation between different dirt types and/or on the basis of the frequency distribution determined by the statistics unit.

For example, a correlation may be determined between ketchup and fat, since fat-containing foods such as French fries or grilled sausage are preferably consumed with ketchup.

According to a further embodiment of the dishwasher, a communication unit is provided, said communication unit being configured to communicate with an external unit, in particular with an external kitchen appliance, a mobile device and/or a server.

The server is, for example, a server of a service provider and/or a manufacture of the dishwasher. The server may be requested, on the one hand, to provide dirt parameter matrices of different dirt types. In embodiments, the communication unit may transmit the received sensor signal to the server which evaluates this sensor signal and reports the determined dirt types back to the dishwasher.

According to a further embodiment of the dishwasher, a user interface is provided for detecting a user input as a function of a dirt type determined by the determining unit.

This is advantageous since, for example, the user may be questioned in the case of an uncertain identification. The user interface may be implemented, in particular, by an application which is installed on a mobile device of the user.

The respective unit, for example the database unit, the comparison unit, the determining unit, the image processing unit, the generating unit, the learning unit, the statistics unit and/or the correlation unit may be implemented in terms of hardware technology and/or software technology. In the case of an implementation in terms of hardware technology, the respective unit may be configured, for example, as a computer or as a microprocessor. In the case of an implementation in terms of software technology, the respective unit may be configured as computer program product, as a function, as a routine, as part of a program code or as an executable object.

According to a second aspect, an arrangement having a dishwasher, in particular a household dishwasher, and a computing unit is proposed, wherein the dishwasher and the computing unit are configured for data communication with one another. The dishwasher comprises a controller for executing a washing program for washing dirty items to be washed. The computing unit comprises a receiving unit for receiving a sensor signal indicative of a dirt type adhering to the dirty items to be washed from a plurality of dirt types, wherein each of the dirt types is determined by a dirt parameter matrix in which each position is assigned to a dirt parameter, wherein a determining unit is provided, said determining unit being configured to determine the dirt type adhering to the dirty items to be washed as a function of the received sensor signal. The controller is configured to execute the washing program as a function of the determined dirt type.

The computing unit receives the sensor signal, in particular from the dishwasher. Alternatively, the computing unit may receive the sensor signal from a device which is external to the dishwasher, for example a mobile device of the user of the dishwasher.

The data communication between the dishwasher and the computing unit is carried out, in particular, via the internet, wherein a communication link is produced, for example by means of a WLAN, mobile radio, a VPN and the like. The computing unit preferably comprises a server. The computing unit may also be configured as an instance of an application on a server.

Advantageously, the computing unit may have a very high computing power, which is why it is possible to determine the dirt type rapidly as a function of the sensor signal by means of complex algorithms.

The embodiments and features described according to the first aspect for the proposed dishwasher accordingly apply to the proposed arrangement of the dishwasher and computing unit. In particular, the different units such as the determining unit, the image processing unit, the database unit, the generating unit, the comparison unit, the learning unit, the statistics unit etc., may be configured as a constituent part of the computing unit.

The computing unit transmits the determined dirt type to the controller, for example, whereupon this controller executes the washing program as a function of the determined dirt type.

According to a third aspect, a method for operating a dishwasher, in particular a household dishwasher, having a controller for executing a washing program for washing dirty items to be washed is proposed. In a first step, a sensor signal indicative of a dirt type adhering to the dirty items to be washed from a plurality of dirt types is received, wherein each of the dirt types is determined by a dirt parameter matrix in which each position is assigned to a dirt parameter. In a second step, the dirt type adhering to the dirty items to be washed is determined as a function of the sensor signal. In a third step, the washing program is executed as a function of the determined dirt type.

This method is preferably executed by a dishwasher according to the first aspect. The method may also be correspondingly executed with the arrangement comprising a dishwasher and a computing unit according to the second aspect.

The embodiments and features described for the proposed dishwasher correspondingly apply to the proposed method.

According to a fourth aspect, a computer program product is proposed, said computer program product comprising commands which, when the program is executed by a computer, cause the computer to execute the method according to the third aspect.

A computer program product, such as for example a computer program means, may be provided or delivered for example as a storage medium, such as for example a memory card, USB stick, CD ROM, DVD, or even in the form of a downloadable file from a server in a network. This may be carried out, for example, in a wireless communication network by transferring a corresponding file with the computer program product or the computer program means.

Further possible implementations of the invention also comprise not explicitly cited combinations of features or embodiments described above or below relative to the exemplary embodiments. In this case, the person skilled in the art will add individual aspects as improvements or additions to the respective basic form of the invention.

BRIEF DESCRIPTION OF THE DRAWINGS

Further advantageous embodiments and aspects of the invention form the subject matter of the subclaims and the exemplary embodiments of the invention described hereinafter. The invention is described in more detail hereinafter by means of preferred embodiments with reference to the accompanying figures.

FIG. 2 shows a general example of a dirt parameter matrix;

FIG. 3 shows specific examples of three dirt parameter matrices;

DETAILED DESCRIPTION OF EXEMPLARY EMBODIMENTS OF THE PRESENT INVENTION

Figure 1:
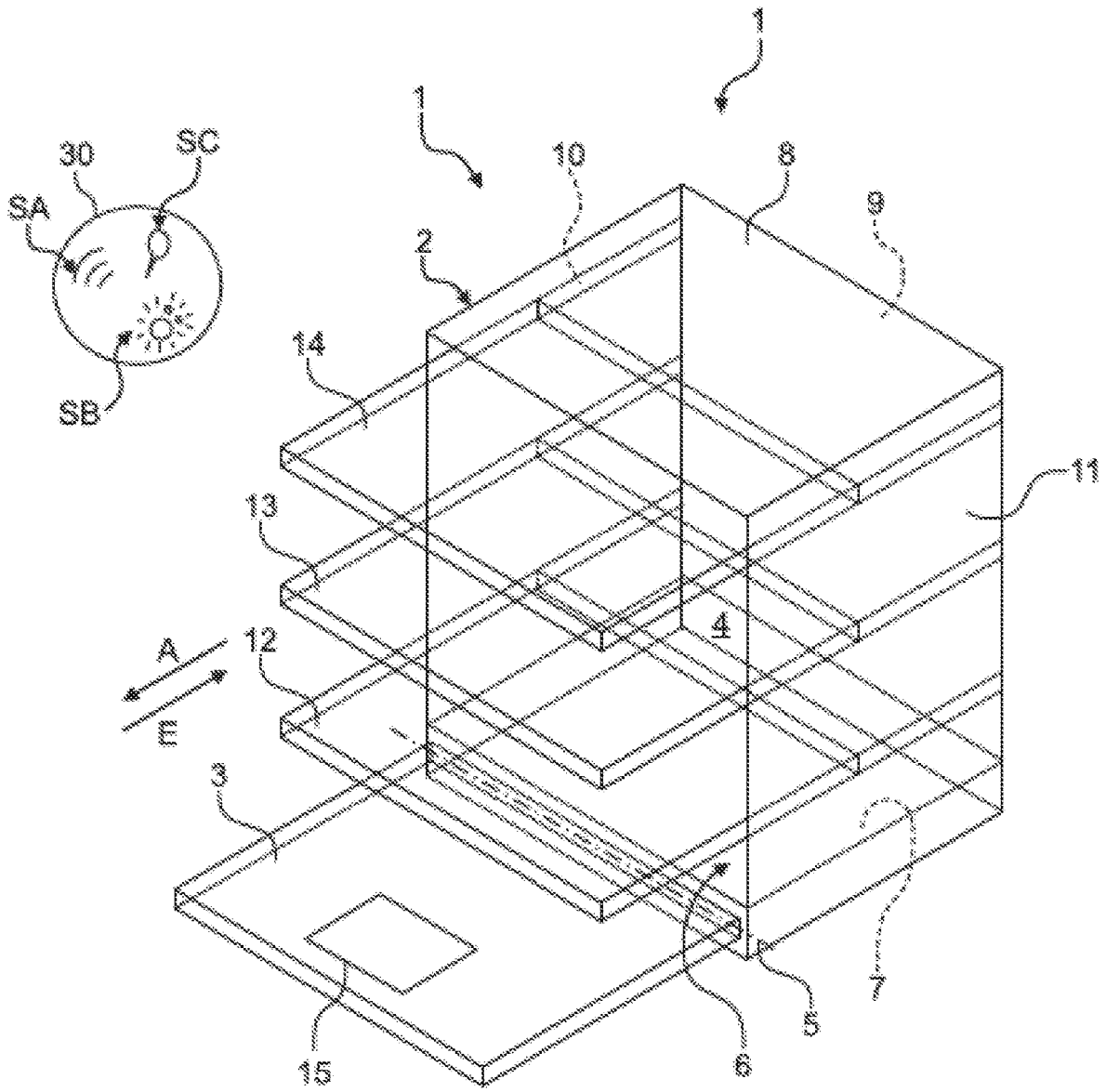
FIG. 1 shows a schematic perspective view of an embodiment of a dishwasher.

Elements which are the same or functionally the same are provided with the same reference characters in the figures unless specified otherwise.

FIG. 1 shows a schematic perspective view of an embodiment of a dishwasher 1 which is configured in this case as a household dishwasher. The household dishwasher 1 comprises a washing container 2 which can be closed by a door 3, in particular in a water-tight manner. To this end, a sealing device may be provided between the door 3 and the washing container 2. The washing container 2 is preferably cuboidal. The washing container 2 may be arranged in a housing of the household dishwasher 1. The washing container 2 and the door 3 may form a washing chamber 4 for washing items to be washed 30.

The door 3 is shown in FIG. 1 in its open position. The door 3 may be closed or opened by pivoting about a pivot axis 5 provided on a lower end of the door 3. A loading opening 6 of the washing container 2 may be closed or opened by means of the door 3. The washing container 2 has a bottom 7, a ceiling 8 arranged opposite the bottom 7, a rear wall 9 arranged opposite the closed door 3, and two opposingly arranged side walls 10, 11. The bottom 7, the ceiling 8, the rear wall 9 and the side walls 10, 11 may be manufactured, for example, from a stainless steel sheet. Alternatively, the bottom 7 may be manufactured, for example, from a plastic material.

The household dishwasher 1 also has at least one receptacle for items to be washed 12 to 14. Preferably, a plurality of receptacles for items to be washed 12 to 14, for example three thereof, may be provided, wherein the receptacle for items to be washed 12 may be a lower receptacle for items to be washed or a lower basket, the receptacle for items to be washed 13 may be an upper receptacle for items to be washed or an upper basket and the receptacle for items to be washed 14 may be a cutlery drawer. As FIG. 1 also shows, the receptacles for items to be washed 12 to 14 are arranged one above the other in the washing container 2. Each receptacle for items to be washed 12 to 14 is able to be selectively displaced into or out of the washing container 2. In particular, each receptacle for items to be washed 12 to 14 is able to be pushed or moved into the washing container 2 in a push-in direction E, and is able to be pulled or moved out of the washing container 2 in a pull-out direction A counter to the push-in direction E.

A controller 15 is also arranged on the door 3 for executing a washing program for washing dirty items to be washed 30. The controller 15 comprises in this example a receiving unit 16 (see FIG. 4) for receiving a sensor signal indicative of a dirt type SA, SB, SC adhering to the dirty items to be washed 30 from a plurality of dirt types SA, SB, SC. Each of the dirt types SA, SB, SC is determined by a dirt parameter matrix MXA, MXB, MXC (see FIG. 3). The dirt is, for example, fat SA, remnants of rice SB and a dark sauce SC. Moreover, the controller 15 has a determining unit 20 (see FIG. 4) which is configured to determine the dirt type SA, SB, SC adhering to the dirty items to be washed 30 as a function of the received sensor signal. The controller 15 executes the washing program as a function of the determined dirt type SA, SB, SC in order to achieve an improved cleaning result.

FIG. 2 shows a general example of a dirt parameter matrix SMX. The general form of the dirt parameter matrix SMX shown has a number of $n^x m$ entries, wherein n is the number of lines and m the number of columns. Each of the entries a_11, a_12, . . . , a_1m, a_21, . . . a_n1, . . . a_nm represents a dirt parameter.

Dirt parameters a_11-a_nm may be subdivided, for example, into different categories or classes. An example of such a subdivision is shown in the following Table 1. The examples shown in Table 1 for dirt parameters a_11-a_nm are based on an optical sensor signal which comprises image information of the dirty items to be washed 30 (see FIG. 1). The image information is received in particular as a digital image, which comprises a plurality of pixels, from the receiving unit 16. Those pixels which show soiling are denoted in Table 1 as dirt pixels.

TABLE 1

| Category | Example 1 | Example 2 |
|---|---|---|
| Spatial distribution | Number of dirt pixels in an edge region of the items to be washed | Average distance of dirt pixels from the center of the items to be washed |
| Morphology | Number of contiguous areas of dirt pixels | Number of pixels of the largest contiguous area |
| Color | Average value of the green value of al ldirt pixels | Standard deviation of the average value of the green value |

TABLE 1-continued

| Category | Example 1 | Example 2 |
|---|---|---|
| Texture | Average grayscale value of all dirt pixels, after the image has been transformed into a grayscale image | Density of dirt pixels, the grayscale value thereof being above the average grayscale value |

It should be mentioned that the categories and the specific examples of Table 1 are to be understood merely by way of example and not exhaustively.

For example, a determination rule which specifies how the respective dirt parameter a_11-a_nm is determined on the basis of the digital image of the items to be washed 30 may be predetermined for each dirt parameter a_11-a_nm. Different dirt parameters a_11-a_nm may be completely independent of one another, such as for example "average distance of dirt pixels from the center of the items to be washed" and "average value of the green value of all dirt pixels" or they may have mutual dependencies, such as for example "average value of the green value of all dirt pixels" and "standard deviation of the average value of the green value".

For a specific dirt type, the different dirt parameters a_11-a_nm have, in particular, characteristic values, i.e. the values are in a specific range which for example may be empirically determined. For example, rice grains have a specific size, for example 1-10 mm, and shape, for example elliptical, wherein these values depend, for example, on an observation angle and the type of rice. Spaghetti has an elongated, contiguous curvilinear structure. For each dirt type, characteristic properties may be used in order to make up a plurality of dirt parameters a_11-a_nm for a dirt parameter matrix SMX, such that the characteristic properties may be differentiated, i.e. the dirt types may be identified using the values of the dirt parameters a_11-a_nm.

FIG. 3 shows specific examples of three dirt parameter matrices MXA, MXB, MXC, for three dirt types SA, SB, SC, (see FIG. 1), wherein for reasons of clarity the dirt parameter matrices MXA, MXB, MXC contain only four dirt parameters. An example of a determined current dirt parameter matrix MXi is also shown.

The dirt types SA, SB, SC are, for example, a dark sauce SA, mayonnaise SB and chocolate sauce SC. The sensor signal is a digital image of the dirty items to be washed 30 (see FIG. 1). The dirt parameters a_11-a_nm (see FIG. 2) represent, for example, a spatial distribution of dirt pixels on the items to be washed, an average brightness of the dirt pixels, a homogeneity of an area formed by the dirt pixels and a number of dirt pixels, the brightness thereof being below a threshold value standardized to the total number of dirt pixels.

The dirt parameter matrices MXA, MXB, MXC, for example, are characteristic of the respective dirt type SA, SB, SC. For each of the defined dirt parameters a_11-a_nm they contain a value range which has been determined, for example, by empirical measurements. The dirt parameter matrix MXA is determined by such a measurement, for example on the basis of a sensor signal of an item to be washed 30 which is soiled only with the dirt type SA. These measurements are preferably carried out by a manufacturer of the dishwasher 1 and the dirt parameter matrices MXA, MXB, MXC provided.

During the operation of the dishwasher 1 the sensor signal of the dirty items to be washed 30 is detected. In particular, a photograph of the items to be washed 30 is taken and transmitted to the receiving unit 16. On the basis of the sensor signal, the current dirt parameter matrix MXi is determined, by the value of each dirt parameter a_11-a_nm being determined on the basis of the sensor signal.

By comparing the current dirt parameter matrix MXi with the dirt parameter matrices MXA, MXB, MXC, in particular it may be determined which dirt type SA, SB, SC is present on the items to be washed 30. The comparison is carried out, in particular, by a comparison unit 24 (see FIG. 4). In this case, for example, a probability for each of the dirt types SA, SB, SC is determined.

The comparison of the current dirt parameter matrix MXi with the dirt parameter matrix MXA reveals, for example, that all values of the current dirt parameter matrix MXi are within the respective value range of the dirt parameter matrix MXA. Thus there is a very high probability that the dirt type SA is present on the items to be washed 30.

The comparison with the further dirt parameter matrices MXB, MXC shows deviations in at least one dirt parameter a_11-a nm. The probability that the dirt type SB is present on the items to be washed 30 is very low, since all parameter values are outside the respective value range of the dirt parameter matrix MXB. The probability that the dirt type SC is present on the items to be washed 30 is moderate, since two parameter values are outside the respective value range of the dirt parameter matrix MXC.

This comparison result may be interpreted differently. A first interpretation could be that only the dirt type SA is present on the items to be washed 30. A second interpretation could be that the dirt type SA is present with a small quantity of the dirt type SB on the items to be washed 30. The interpretation of the comparison result is executed, in particular, by a determining unit 20 (see FIG. 4).

Figure 4:
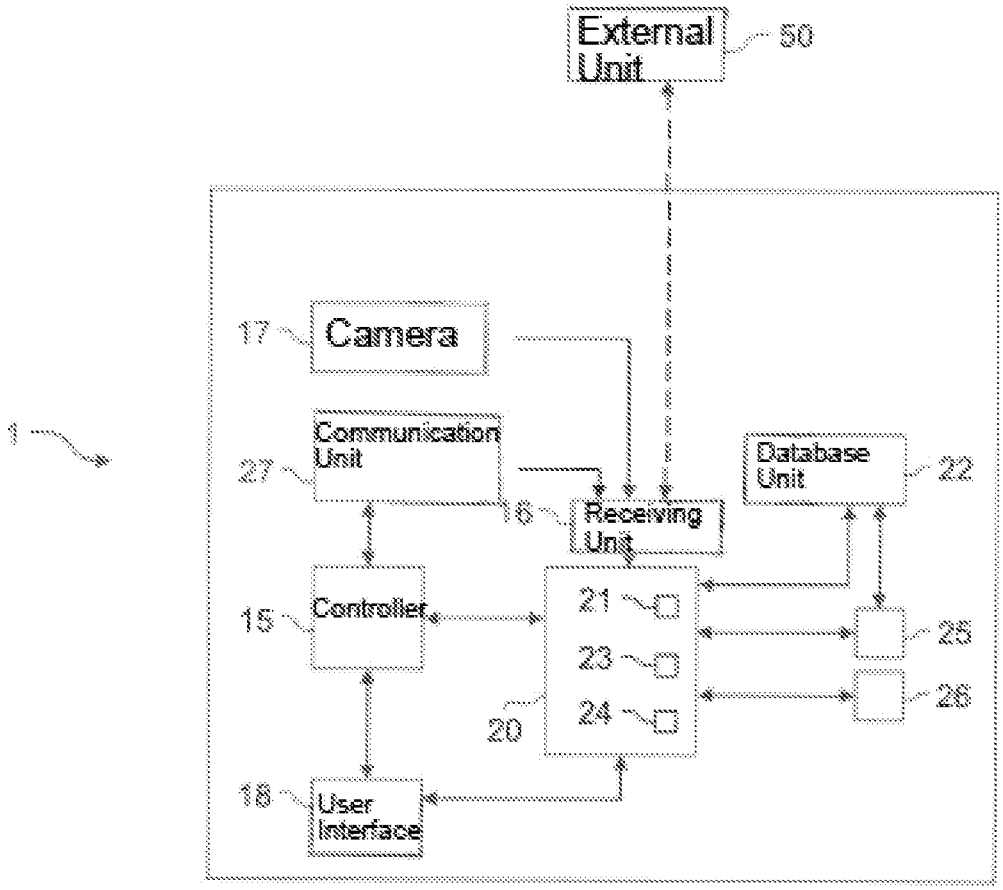
FIG. 4 shows a schematic block diagram of an exemplary embodiment of a dishwasher.

FIG. 4 shows a schematic block diagram of an exemplary embodiment of a dishwasher 1. For example, it is the household dishwasher 1 of FIG. 1. The household dishwasher comprises a controller 15, a receiving unit 16, a camera 17, a user interface 18, a determining unit 20, which has an image processing unit 21, a generating unit 23 and a comparison unit 24 as constituent parts, a database unit 22, a learning unit 25, a statistics unit 26 and a communication unit 27.

The receiving unit 16 is configured to receive a sensor signal of dirty items to be washed 30 (see FIG. 1). The sensor signal may be provided in this case by the camera 17 in the form of an image or photograph of the items to be washed 30. Alternatively or additionally, the sensor signal may be received by an external unit 50, for example a mobile device of the user. Moreover, the sensor signal may be received by the communication unit 27 and provided on the receiving unit 16. The receiving unit 16 transmits the received sensor signal to the determining unit 20. The determining unit 20 is configured to determine a dirt type SA, SB, SC adhering to the items to be washed 30 (see FIG. 1).

In this example, the sensor signal comprises an image of the items to be washed 30. The received sensor signal is processed by means of the image processing unit 21. In particular, a value is determined for each dirt parameter a_11-a_nm. The generating unit 23 generates a current dirt parameter matrix MXi (see FIG. 3) from the determined values. The comparison unit 24 compares the current dirt parameter matrix MXi with stored dirt parameter matrices MXA, MXB, MXC (see FIG. 3) which retrieves them from the database unit 22. Preferably, the current dirt parameter matrix MXi is compared with each stored dirt parameter matrix MXA, MXB, MXC. As a comparison result, for example, a probability is determined that the dirt type SA, SB, SC represented by the respective stored dirt parameter matrix MXA, MXB, MXC is present on the items to be washed 30. Based on the comparison result, the determining unit 20 determines which of the dirt types SA, SB, SC is present on the items to be washed 30 and provides this to the controller 15. The controller 15 immediately executes a washing program which is adapted, in particular, specifically to the dirt types SA, SB, SC present.

By means of the user interface 18 the user of the household dishwasher 1 may be informed about identified dirt types SA, SB, SC and/or the user may be requested to confirm an identified dirt type SA, SB, SC. Such a confirmation on the part of the user may be advantageously used by the learning unit 25 to adapt the dirt parameter matrices SA, SB, SC stored in the database unit 22, so that the determination of the dirt types SA, SB, SC is improved in the future.

The statistics unit 26 is configured on the basis of the determined dirt types SA, SB, SC to determine a frequency distribution which contains a statistical probability of the occurrence of specific dirt types SA, SB, SC for future determinations. In this case, in particular, a correlation between different dirt types SA, SB, SC and a correlation between a time of the occurrence and a dirt type SA, SB, SC may be determined, which may improve the determination of the dirt types SA, SB, SC in the future.

The communication unit 27 is configured, in particular, to communicate with other household appliances of the user, such as a food processor, a cooking appliance and/or a refrigerator, or with applications such as a digital cookbook or calendar of the user. Additional information relative to a dirt type SA, SB, SC to be expected may be received and evaluated from these external devices in order to improve the determination of the dirt types SA, SB, SC.

Figure 5:
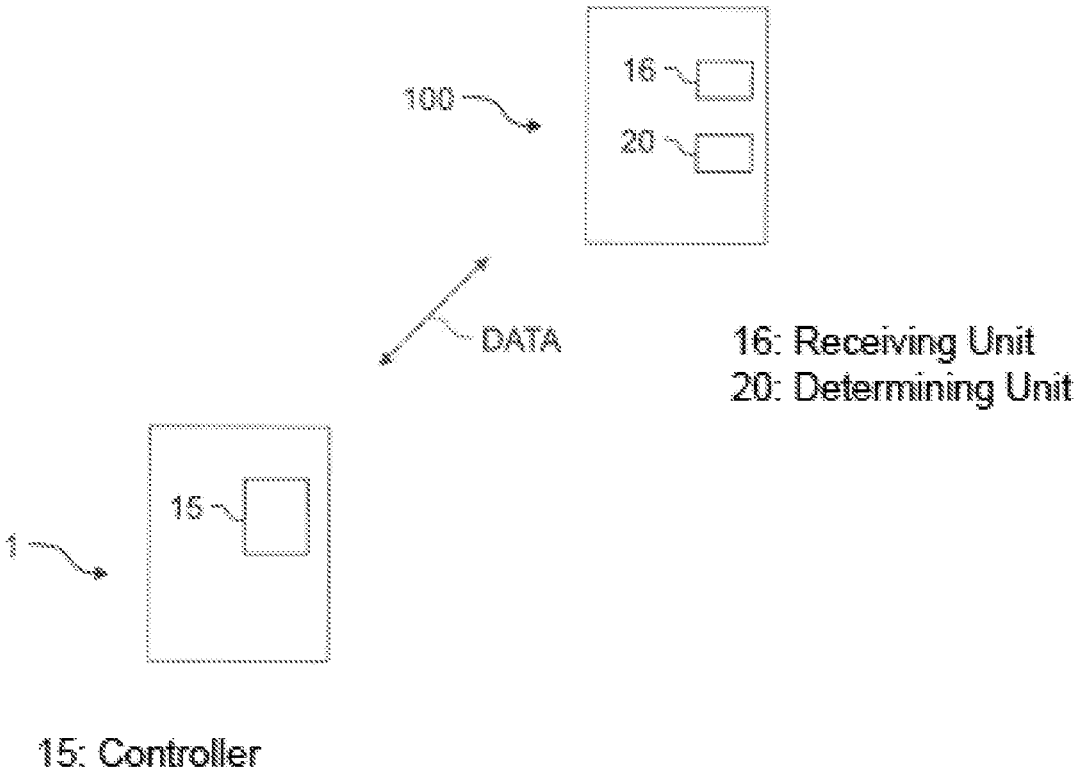
FIG. 5 shows a schematic block diagram of an exemplary arrangement with a dishwasher and a computing unit.

FIG. 5 shows a schematic block diagram of an exemplary arrangement with a dishwasher 1, for example the household dishwasher 1 of FIG. 1, and a computing unit 100. The dishwasher 1 and the computing unit 100 are configured to communicate with one another by means of a communication link DATA. The computing unit 100 is configured, for example, as a server and is able to be accessed via the internet. The dishwasher 1 thus comprises a network interface such as a WLAN module, so that it may produce a communication link with the server 100 via the internet access on the part of the user. In this arrangement the dishwasher 1 may have a relatively simple construction. In particular, it may be sufficient if the dishwasher has a controller 15 (see FIG. 1 or 4). The receiving unit 16 (see FIG. 4) and the determining unit 20 (see FIG. 4) are encompassed in this case, in particular, by the server 100. Further optional units such as an image processing unit 21 (see FIG. 4), a generating unit 23 (see FIG. 4), a comparison unit 24 (see FIG. 4), a database unit 22 (see FIG. 4), a learning unit 25 (see FIG. 4) and/or a statistics unit 26 (see FIG. 4) are preferably also encompassed by the server 100, but may also be encompassed by the dishwasher 1.

This arrangement has the advantage, in particular, that the high computing power of the server 100 is available for determining the dirt types SA, SB, SC (see FIG. 1), which shortens a determination time.

Figure 6:
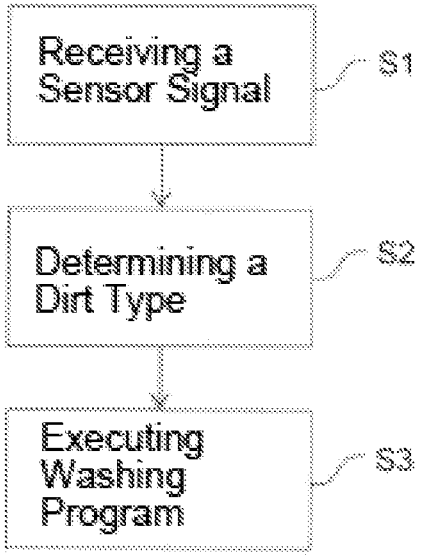
FIG. 6 shows a schematic block diagram of an exemplary embodiment of a method for operating a dishwasher.

FIG. 6 shows a schematic block diagram of an exemplary embodiment of a method for operating a dishwasher 1, in particular the household dishwasher 1 of FIG. 1 or 4, but also the dishwasher 1 in the arrangement having the computing unit 100 of FIG. 5. The dishwasher 1 comprises a controller 15 (see FIG. 1 or 4) for executing a washing program for washing dirty items to be washed 30 (see FIG. 1). In a first step 51, a sensor signal which is indicative of a dirt type SA, SB, SC adhering to the dirty items to be washed 30 (see FIG. 1) from a plurality of dirt types SA, SB, SC is received. In a second step S2, the dirt type SA, SB, SC adhering to the dirty items to be washed 30 is determined as a function of the sensor signal. In a third step S3, the washing program is executed as a function of the determined dirt type SA, SB, SC.

While the present invention has been described with reference to exemplary embodiments, it may be modified in a variety of ways.

The invention claimed is:

1. A dishwasher, comprising:

a controller configured to execute a washing program for washing a dirty item to be washed;

a receiving unit configured to receive a sensor signal indicative of a dirt type adhering to the dirty item to be washed from a plurality of dirt types, with each of the dirt types being determined by a dirt parameter matrix, in which each position is assigned to a dirt parameter; and a determining unit configured to determine the dirt type adhering to the dirty item to be washed as a function of the received sensor signal, wherein the controller is configured to execute the washing program as a function of the determined dirt type.

2. The dishwasher of claim 1, constructed in the form of a household dishwasher.

3. The dishwasher of claim 1, wherein the sensor signal comprises an image information of the dirty item to be washed.

4. The dishwasher of claim 3, wherein the determining unit comprises an image processing unit which is configured to determine as a function of the image information a value of the dirt parameter contained in the dirt parameter matrix.

5. The dishwasher of claim 1, further comprising:

a database unit configured to store a dirt parameter matrix for each of a plurality of dirt types, with the dirt parameter matrices comprising each a predetermined value or value range for the dirt parameters;

a generating unit configured to generate a current one of the dirt parameter matrices as a function of the determined value of the dirt parameter; and a comparison unit configured to compare the generated current one of the dirt parameter matrices with at least one subset of the dirt parameter matrices stored in the database unit and to output a comparison result, wherein the determining unit is configured to determine the dirt type adhering to the dirty item to be washed as a function of the comparison result.

6. The dishwasher of claim 5, further comprising a learning unit configured to adapt at least one of the dirt parameter matrices stored in the database unit as a function of determined values of at least one of the dirt parameters.

7. The dishwasher of claim 1, wherein the sensor signal comprises information relating to a washing liquor used for washing the dirty item to be washed.

8. The dishwasher of claim 1, wherein the sensor signal comprises information relating to a food prepared and/or consumed by a user of the dishwasher in a specific time interval before a start of the washing program.

9. The dishwasher of claim 1, wherein the controller is configured to adapt execution of the washing program while running.

10. The dishwasher of claim 1, further comprising a camera arranged on the dishwasher and configured to detect an optical sensor signal of the item to be washed and to output the detected optical sensor signal to the receiving unit.

11. The dishwasher of claim 1, further comprising a statistics unit configured to determine a frequency distribution which comprises a frequency of the occurrence of different dirt types, said determining unit being configured to determine the dirt type adhering to the dirty item to be washed as a function of the frequency distribution.

12. The dishwasher of claim 1, further comprising a communication unit configured to communicate with an external unit selected from the group consisting of an external kitchen appliance, a mobile device, and a server.

13. The dishwasher of claim 1, further comprising a user interface configured to detect a user input as a function of the dirt type determined by the determining unit.

* * * * *